US009644573B2

(12) United States Patent
Dale

(10) Patent No.: US 9,644,573 B2
(45) Date of Patent: May 9, 2017

(54) SYSTEM, METHOD, AND APPARATUS FOR THERMAL MANAGEMENT WITH CHARGE AIR COOLER BYPASS

(71) Applicant: Cummins Inc., Columbus, IN (US)

(72) Inventor: Adrian P. Dale, Columbus, IN (US)

(73) Assignee: Cummins Inc., Columbus, IN (US)

( * ) Notice: Subject to any disclaimer, the term of this patent is extended or adjusted under 35 U.S.C. 154(b) by 780 days.

(21) Appl. No.: 13/645,055

(22) Filed: Oct. 4, 2012

(65) Prior Publication Data

US 2013/0111898 A1 May 9, 2013

Related U.S. Application Data

(60) Provisional application No. 61/543,401, filed on Oct. 5, 2011.

(51) Int. Cl.
*F02B 33/44* (2006.01)
*F02M 25/07* (2006.01)
*F02M 26/04* (2016.01)

(52) U.S. Cl.
CPC ..... *F02M 25/0706* (2013.01); *F02M 26/04* (2016.02)

(58) Field of Classification Search
CPC ..... F02M 25/0706; F02M 25/0715; F02M 25/0718; F02M 25/0726; F02M 25/0728; F02M 25/0729; F01N 3/025; F01N 3/029; F02C 6/12; F02B 29/0418; F05B 2220/40; F02D 41/0007; Y02T 10/144; Y02T 10/24; Y02T 10/26
USPC .... 60/605.2, 605.1, 280, 278, 303; 701/108; 123/563
See application file for complete search history.

(56) References Cited

U.S. PATENT DOCUMENTS

| | | | | |
|---|---|---|---|---|
| 6,286,482 | B1 | 9/2001 | Flynn et al. | |
| 7,007,680 | B2 | 3/2006 | Tussing et al. | |
| 7,079,938 | B2 * | 7/2006 | Bhargava et al. | 701/108 |
| 7,163,005 | B2 | 1/2007 | Tussing et al. | |
| 7,222,614 | B2 | 5/2007 | Bryant | |
| 7,257,950 | B2 | 8/2007 | Iwaszkiewicz | |
| 7,302,939 | B2 | 12/2007 | Hill et al. | |
| 7,454,896 | B2 | 11/2008 | Chalgren et al. | |
| 7,461,641 | B1 * | 12/2008 | Styles et al. | 123/568.12 |
| 7,530,336 | B2 | 5/2009 | Brecheisen | |

(Continued)

*Primary Examiner* — Jesse Bogue
*Assistant Examiner* — Thomas Olszewski
(74) *Attorney, Agent, or Firm* — Taft Stettinius & Hollister LLP

(57) ABSTRACT

A system includes an internal combustion engine, an EGR flow path having an EGR cooler path and an EGR cooler bypass path, a turbocharger, a compressed intake flow path, an EGR bypass valve that selectively divides the EGR flow between the EGR cooler path and the EGR cooler bypass path, a charge air cooler bypass valve that reduces an amount of cooling of compressed intake air out of the compression side of the turbocharger, and an aftertreatment component that receives the exhaust stream from the turbine side of the turbocharger. The aftertreatment component requires at least intermittent exhaust stream temperature elevation. The system includes a controller that determines that an exhaust stream temperature elevation request is present, and provides a charge air cooler bypass valve command and an EGR bypass valve command in response to the exhaust stream temperature elevation request.

19 Claims, 4 Drawing Sheets

(56) References Cited

U.S. PATENT DOCUMENTS

| | | | | |
|---|---|---|---|---|
| 2004/0244782 | A1 | 12/2004 | Lewallen | |
| 2006/0201143 | A1* | 9/2006 | Jacobsson et al. | 60/295 |
| 2007/0199320 | A1* | 8/2007 | Yager et al. | 60/599 |
| 2008/0173016 | A1* | 7/2008 | Barthelet | 60/602 |
| 2010/0186378 | A1* | 7/2010 | Ueda et al. | 60/276 |

* cited by examiner

SYSTEM, METHOD, AND APPARATUS FOR THERMAL MANAGEMENT WITH CHARGE AIR COOLER BYPASS

RELATED APPLICATIONS

This application is related to, and claims the benefit of, U.S. Provisional Patent Application 61/543,401 entitled "SYSTEM, METHOD, AND APPARATUS FOR THERMAL MANAGEMENT WITH CHARGE AIR COOLER BYPASS" filed on Oct. 5, 2011, which is incorporated herein by reference in the entirety for all purposes.

BACKGROUND

The technical field generally relates to engine systems having an aftertreatment, EGR, and a compressor. Aftertreatment systems often require periodic or intermittent temperature based regeneration operations. Achieving the temperature based regeneration is a challenge in many applications, and achieving the regeneration in a manner that does not have a strong negative impact on fuel efficiency or emissions is a further challenge. Therefore, further technological developments are desirable in this area.

SUMMARY

One embodiment is a unique system for increasing aftertreatment temperatures using an EGR bypass valve and/or a charge air cooler bypass valve. This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
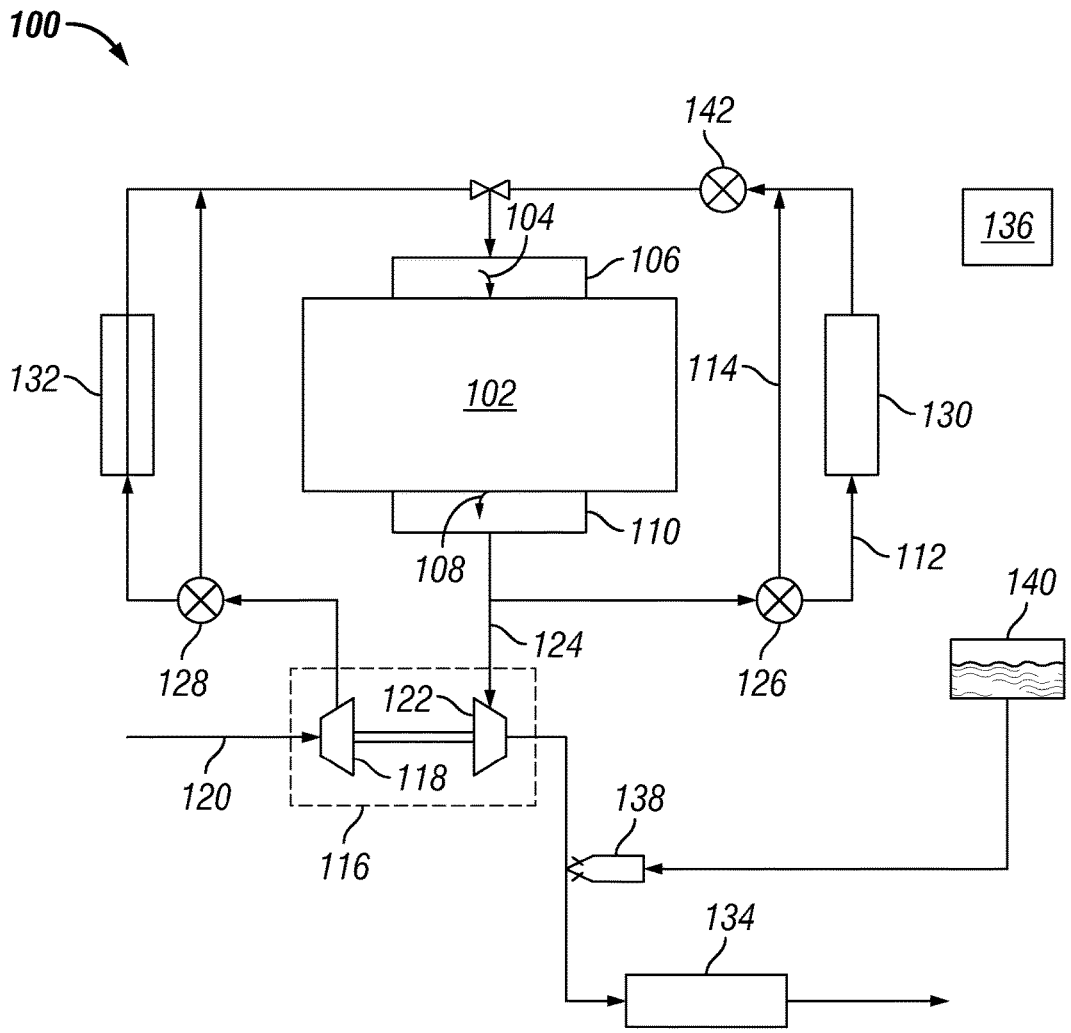
FIG. 1 is a schematic diagram of a system for thermal management with a charge air cooler bypass.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referencing FIG. 1, a system 100 includes an internal combustion engine 102 receiving an intake stream 104 from an intake manifold 106 and delivering an exhaust stream 108 to an exhaust manifold 110. The system 100 further includes an EGR flow path fluidly coupling the exhaust manifold 110 to the intake manifold 106, where the EGR flow path includes an EGR cooler path 112 and an EGR cooler bypass path 114. The system 100 further includes a turbocharger 116 that compresses intake air 120 on a compression side 118 and receives work from the exhaust stream 124 on a turbine side 122. The compressed intake flow path fluidly couples the compression side 118 of the turbocharger 116 to the intake manifold 106. The exemplary compressed intake flow path includes a charge air cooler 132 and a charge air cooler bypass valve 128 that routes any portion of the compressed intake air, including none or all, around the charge air cooler 132. The charge air cooler bypass valve 128 may be any type of valve known in the art, and may further be in communication with a controller 136 and responsive to a charge air cooler bypass valve command from the controller 136. In certain embodiments, the charge air cooler bypass valve 128 reduces an amount of cooling of compressed intake air out of the compression side 118 of the turbocharger 116. In the exemplary system 100 the charge air cooler bypass valve 128 routes a portion of the compressed air past the charge air cooler 132, but the valve 128 may reduce the cooling by any means understood in the art, including at least reducing flow on a coolant side of the charge air cooler 132, for example by reducing a coolant flow in a water jacket (not shown) or reducing air flow around an air-to-air charge air cooler 132 (not shown).

The system 100 further includes an EGR bypass valve 126 that selectively divides the EGR flow between the EGR cooler path 112 and the EGR cooler bypass path 114. The EGR bypass valve 126 routes any portion or all of the EGR flow around the EGR cooler 130. In certain embodiments, the EGR cooler 130 experiences fouling at low flow rates, and the EGR bypass valve 126 operates preferentially or completely in a binary mode—i.e. bypassing all or none of the EGR flow. In certain embodiments, the system 100 includes more than one EGR cooler 130, configured in series, parallel, or both, allowing various EGR bypass valves 126 to bypass one or more of the EGR coolers 130, or to select EGR coolers 130 of various sizes and thereby allow modulated cooling while providing binary flow to particular EGR coolers 130. In certain embodiments, including the exemplary system 100, a single EGR cooler 130 is provided. The EGR bypass valve 126 is actuated by any means understood in the art, including at least hydraulic, pneumatic, or electrical, and is responsive to an EGR bypass valve command from the controller 136.

The system 100 further includes an aftertreatment component 134 receiving the exhaust stream 124 from the turbine side 122 of the turbocharger 116. The aftertreatment component 134 requires at least intermittent exhaust stream temperature elevation. Exhaust temperature elevation is any temperature in the exhaust stream that is greater than is normally provided by the operations of the engine 102. For example, the aftertreatment component may require a rapid warm-up after the engine 102 starts to allow the aftertreatment component to begin functioning properly, the aftertreatment component 134 may require an elevated temperature to regenerate, and/or the aftertreatment component 134 may require an elevated temperature to perform a pretreatment (e.g. oxidizing dosed hydrocarbons) for a downstream aftertreatment component 134 (not shown). The exemplary reasons for the aftertreatment component 134 requiring temperature elevation are non-limiting. The aftertreatment component 134 may be any aftertreatment component 134 known in the art, including at least a particulate filter, a $NO_x$ adsorption catalyst, a selective $NO_x$ reduction catalyst, an oxidizing catalyst, and/or a decomposition tube.

In certain embodiments, the system 100 includes a fuel-consuming temperature generation system. The exemplary system 100 includes a hydrocarbon injector 138 that injects hydrocarbons into the exhaust stream at a position upstream of the aftertreatment component 134. The hydrocarbon injector 138 is fluidly coupled to a fuel source 140, for example the fuel utilized by the engine 102. Any other fuel-consuming temperature-generation system known in the art is also contemplated herein, including at least hydrocarbons injected in a very late post injection by the engine 102, an intake throttle or exhaust throttle, or any other device that takes fuel directly into temperature or that takes work from the engine to generate temperature thereby consuming fuel and converting the fuel indirectly into temperature.

The system may additionally or alternatively include oxidation catalysts, particulate filters, a reductant (e.g. urea) source and injection system, sensors (pressure, temperature, composition, etc.), or any other features or devices known in the art. Any such devices may be included, but are not depicted to avoid obscuring aspects of the present disclosure.

In certain embodiments, the system 100 further includes a controller 136 structured to perform certain operations to perform thermal management with a charge air bypass valve 128. In certain embodiments, the controller 136 forms a portion of a processing subsystem including one or more computing devices having memory, processing, and communication hardware. The controller 136 may be a single device or a distributed device, and the functions of the controller 136 may be performed by hardware or software. In certain embodiments, the controller 136 includes one or more modules structured to functionally execute the operations of the controller 136. In certain embodiments, the controller includes an exhaust stream temperature module, an engine conditions module, a bypass control module, and/or a cooler heating capability module.

The description herein including modules emphasizes the structural independence of the aspects of the controller 136, and illustrates one grouping of operations and responsibilities of the controller 136. Other groupings that execute similar overall operations are understood within the scope of the present application. Modules may be implemented in hardware and/or software on computer readable medium, and modules may be distributed across various hardware or software components. More specific descriptions of certain embodiments of controller operations are included in the section referencing FIG. 3.

The controller 136 determines that an exhaust stream temperature elevation request is present, and provides a charge air cooler bypass valve command and an EGR bypass valve command in response to the exhaust stream temperature elevation request. In certain embodiments the controller 136 provides the EGR bypass valve command as a binary command having possible values of ON and OFF, or zero bypass and full bypass. Another exemplary operation includes the controller 136 preferentially utilizing the EGR bypass valve command to achieve the exhaust stream temperature elevation request, and switching to utilizing the charge air cooler bypass valve command in response to an intake manifold temperature limit, an engine operating condition, an engine startup condition, an engine load value being lower than a threshold, and/or an EGR flow control valve temperature limit. For example, increased EGR bypass increases the intake manifold temperature, and at low total flow rates, high EGR flow rates, or high EGR temperatures the EGR bypass can cause the intake manifold to exceed rated temperatures. Exemplary rated intake manifold temperatures can be in the region of 220° F. (the exact value for a system 100 will be known by one of skill in the art contemplating the specific system). Increased EGR bypass can also exceed the temperature rating of an EGR flow control valve 142 (which may be in the range of 650° F., depending upon the specific valve) when the EGR flow control valve 142 is a valve designed to be positioned downstream of the EGR cooler 130. Exemplary, non-limiting engine operating conditions that may indicate utilizing the charge air cooler bypass valve 128 rather than the EGR bypass valve 126 include low air flow rates, low engine loads, low engine speeds, high engine loads at low air flow rates, a recent engine start event, and/or conditions wherein one or more cylinders are not presently fueling.

In certain embodiments, the charge air cooler bypass valve 128 is utilized at engine startup or during a cold ambient air condition, because the thermal mass of the parts in the charge air cooler bypass path may be lower than the thermal mass of parts in other parts of the system, including the EGR flow path. In another exemplary operation, the controller 136 preferentially utilizes, in order, the EGR bypass valve command, the charge air cooler bypass valve command, and the fuel-consuming temperature generation system to achieve the exhaust stream temperature elevation request.

Figure 4:
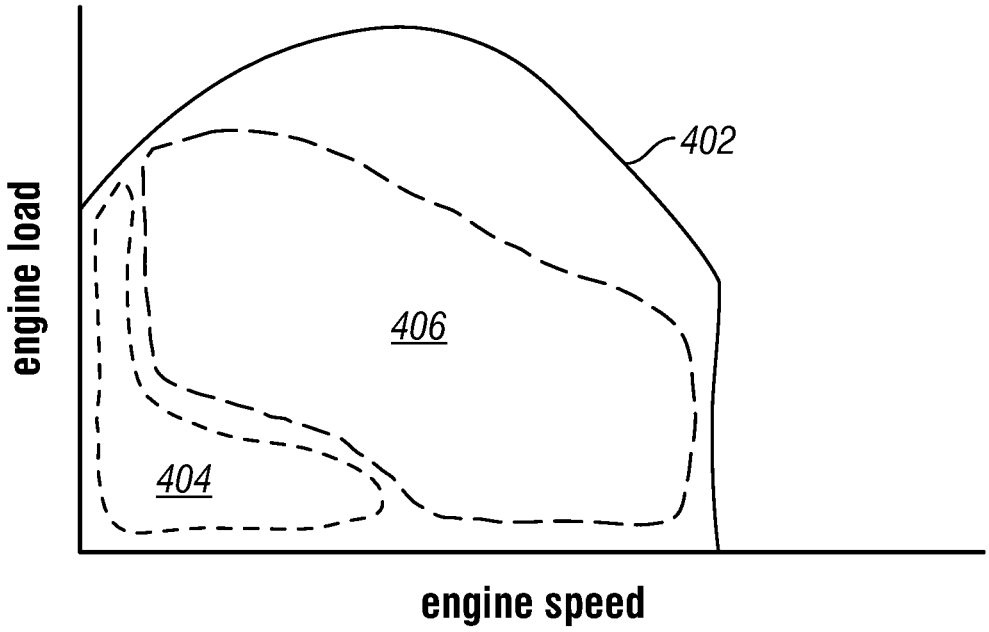
FIG. 4 is an illustration of a first set of engine conditions and a second set of engine conditions.

In another exemplary embodiment, the controller 136 further utilizes the EGR bypass valve command to achieve the exhaust stream temperature elevation request at a first predefined set of engine operating conditions. For example, referencing FIG. 4, a first engine operating condition 404 and a second engine operating condition 406 are presented on an engine speed-load graph. The example of FIG. 4 includes a torque curve 402 for illustration. The first engine operating condition 404 is a region, in one example, having relatively low flow rates and high EGR temperatures. However, the specific regions defining the first engine operating condition 404 and second engine operating condition 406 may be any region understood in the art, including regions that are defined by other parameters than an engine torque and engine speed. The example of FIG. 4 includes an area above the engine operation conditions 404, 406 and under the torque curve 402 that is not defined. In certain embodiments, the undefined region may include areas where thermal management is not typically needed, not typically available, and/or the system may not have any undefined regions under the torque curve 402. In certain embodiments, the controller 136 utilizes the charge air cooler bypass valve command to achieve the exhaust stream temperature elevation request at a second predefined set of engine operating conditions 406.

A further exemplary embodiment includes the controller 136 providing the EGR bypass valve command as a binary command having possible values of ON and OFF, and the charge air cooler bypass valve command as a modulated command. For example, the controller 136 may operate in the first predefined set of engine operating conditions 404 by modulating the charge air cooler bypass valve command, and operate in the second predefined set of engine operating conditions 406 by providing the EGR bypass valve command as a binary command—e.g. ON when thermal management or temperature elevation is required and OFF when thermal management or temperature elevation is not required. Another exemplary operation of the controller 136 includes operating the EGR cooler and/or the charge cooler as a heater in response to the exhaust stream temperature elevation request. For example, the controller 136 may determine that present system conditions allow operation of the cooler(s) as a heater, and operating the cooler(s) as a heater to heat the exhaust stream (by heating the intake manifold). The operation of a cooler as a heater includes passive or active operations of the cooler. For example, where the coolant side of the heater is warmer than the EGR side or compressed air side (e.g. right at startup with a warm engine and cold ambient air), a passive heating operation is possible. Where the cooler is explicitly structured to operate as a heater (e.g. a compressor on the coolant, or with an electric heating element), an active heating operation is possible.

Figure 2:
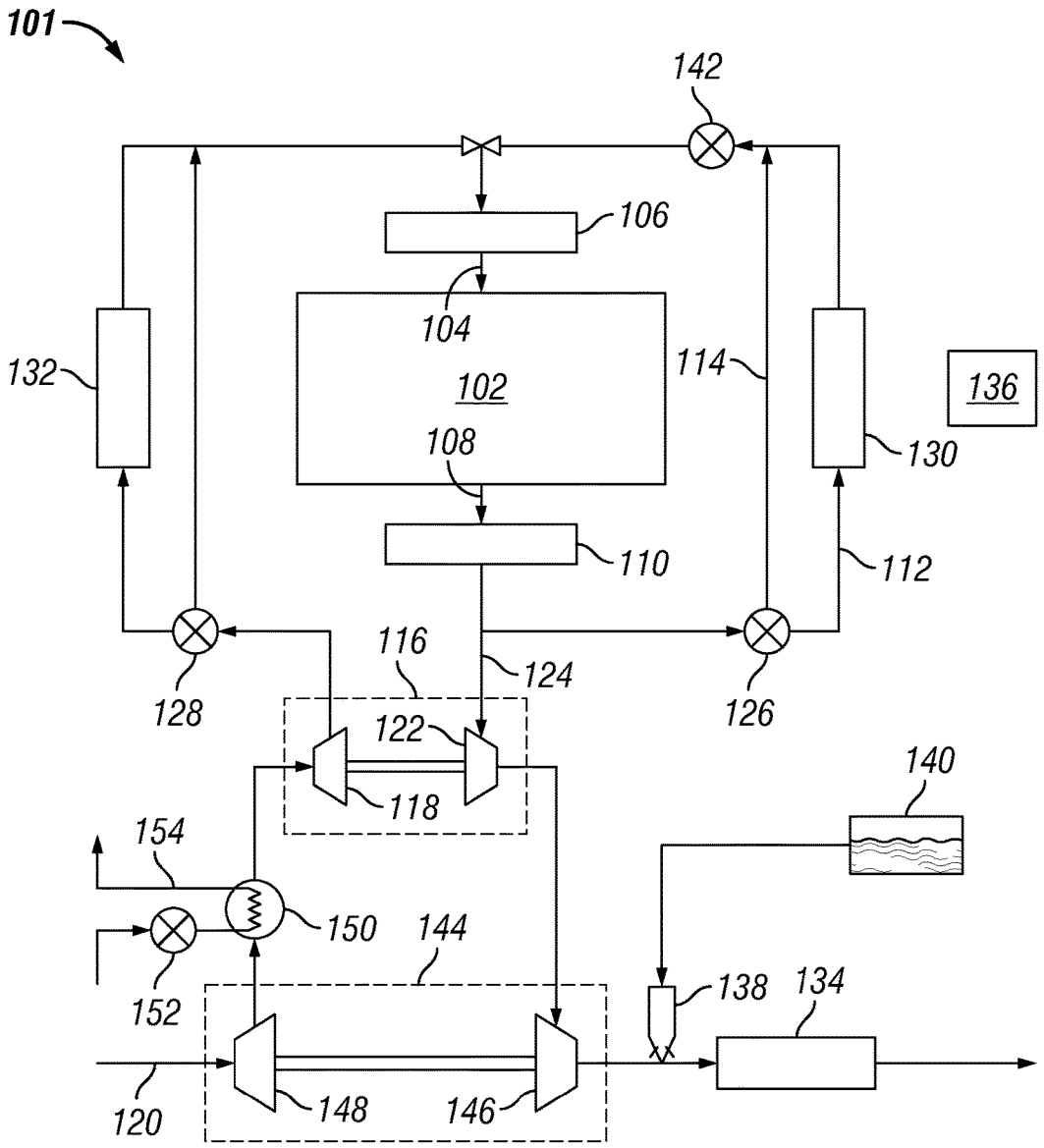
FIG. 2 is a schematic diagram of an alternate system for thermal management with a charge air cooler bypass.

Referencing FIG. 2, an exemplary system 101 includes a second turbocharger stage 144, where the charge air cooler 132 cools compressed air from either turbocharger stage, or two charge air coolers 132, 150 cool compressed air from each turbocharger stage. The charge air coolers 132, 150 may be water (engine coolant) jacket coolers, air-to-air coolers, and/or any other type of cooler known in the art. In the example of FIG. 2, a second charge air cooler 150 is a water jacket cooler utilizing engine coolant on the liquid side 154. Where two charge air coolers 132, 150 are present, the controller 136 performing any of the described operations utilizing either or both coolers 132, 150. Without limitation, the controller 136 may command a first charge air cooler bypass 128 at certain engine operating conditions, a second charge air cooler bypass 152 at certain engine operating conditions, and/or both charge air cooler bypasses 128, 152 at certain engine operating conditions. The controller 136 commands the charge air cooler bypass 128, 152 to bypass compressed air past the cooler (e.g. at bypass 128), or by reducing coolant flow 154 to the cooler (e.g. at bypass 152), thereby reducing the cooling of the compressed air in the charge air cooler 132, 150. In certain embodiments, the systems 100, 101 include a number of EGR bypass valves configured in a multiple (e.g. parallel) and/or staged (e.g. series) flow arrangement.

Figure 3:
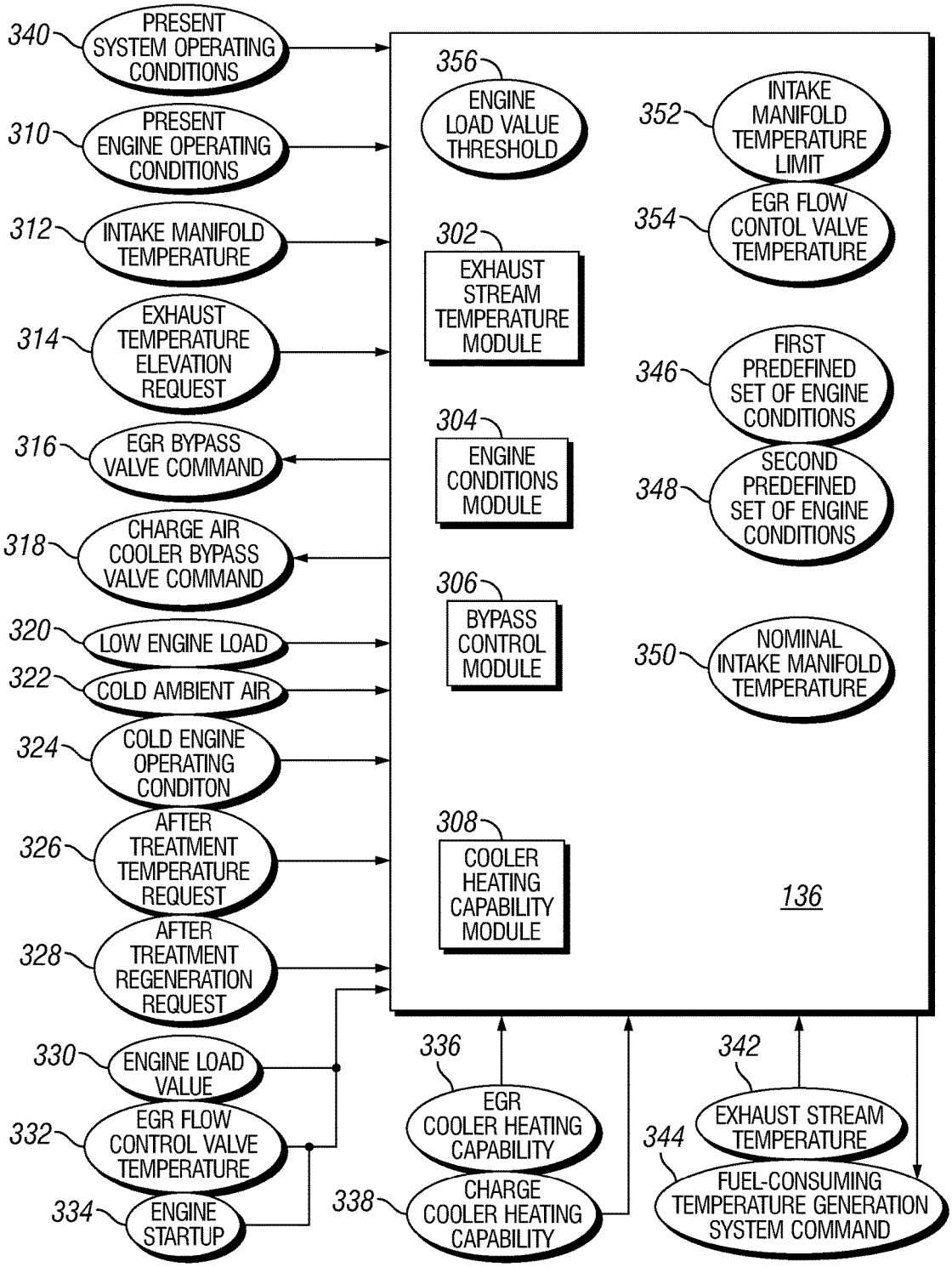
FIG. 3 is a schematic diagram of an apparatus for thermal management with a charge air cooler bypass.

FIG. 3 is a schematic illustration of a controller 136 including an exhaust stream temperature module 302 that determines that an exhaust stream temperature elevation request 314 is present, an engine conditions module 304 that determines present engine operating conditions 310, and a bypass control module 306 that increases an intake manifold temperature 312 above a nominal intake manifold temperature 350 by operating at least one of an EGR bypass valve and a charge air cooler bypass valve in response to the exhaust stream temperature elevation request 314 and the present engine operating conditions 310. The exhaust stream temperature elevation request 314 is any parameter available to the controller 136 indicating that an elevated exhaust temperature is required or desired, and may be determined from an explicit temperature request, an aftertreatment regeneration request, a parameter indicating that an aftertreatment component should operate at a temperature greater than the temperature provided by nominal engine operations, or any other parameter understood in the art.

The present engine operating conditions 310, in certain embodiments, include any engine operation parameters available to the controller 136, including engine speed, load, operating modes, any pressure or sensor values in the system 100, or any other parameter known in the art that allow the controller 136 to determine whether a temperature request is active, what are the current and/or available temperature values of the exhaust stream, and what thermal management capabilities are enabled for achieving the temperature. The present engine operating conditions 310 may exclude any parameter not necessary for the operations of the controller 136 for the specific embodiment. Some of the parameters comprising the present engine operating conditions 310, in certain embodiments, appear on FIG. 3 separately for purposes of specific illustration.

The exemplary controller 136 includes the exhaust stream temperature module 302 determining that the exhaust stream temperature elevation condition request 314 is present in response to a low engine load condition 320, a cold ambient air condition 322, a cold engine operating temperature condition 324, an aftertreatment temperature request condition 326, and/or an aftertreatment regeneration request condition 326. In certain embodiments, the bypass control module 306 operates the EGR bypass valve as a binary valve having an ON and an OFF position.

An exemplary controller 136 includes the bypass control module 306 preferentially utilizing the EGR bypass valve to increase the intake manifold temperature 312, and switching to utilizing the charge air cooler bypass valve in response to an intake manifold temperature limit 352, an engine operating condition 310, an engine startup condition 334, an engine load value 330 being lower than a threshold 356, and/or an EGR flow control valve temperature limit 354. An exemplary controller 136 includes the bypass control module 306 preferentially utilizing, in order, the EGR bypass valve, the charge air cooler bypass valve, and a fuel-consuming temperature generation system to increase the intake manifold temperature. The bypass control module 306 controls the fuel-consuming temperature generation system by issuing a fuel-consuming temperature generation system command 344. The fuel-consuming temperature generation system command 344 may be a temperature instruction, or specific system actuation instructions (e.g. fueling, timing, etc.). In certain embodiments, the bypass control module 306 controls the EGR bypass valve by issuing an EGR bypass valve command 316, and controls the charge air cooler bypass valve by issuing a charge air cooler bypass valve command 318.

Another exemplary controller 136 includes the bypass control module 306 further utilizing the EGR bypass valve to increase the intake manifold temperature 312 at a first predefined set of engine operating conditions 346, and utilizing the charge air cooler bypass valve to increase the intake manifold temperature 312 at a second predefined set of engine operating conditions 348. A further exemplary controller 136 includes the bypass control module 306 operating the EGR bypass valve as a binary valve having an ON and an OFF position, and operating the charge air cooler bypass valve as a modulated valve.

In certain embodiments, the controller 136 includes a cooler heating capability module 308 that determines whether present system operating conditions 340 indicate an EGR cooler heating capability 336 and/or a charge cooler heating capability 338, and the bypass control module 306 further operates the EGR cooler and/or the charge cooler as a heater to increase the intake manifold temperature 312 in response to the EGR cooler heating capability 336 and/or the charge cooler heating capability 338. An exemplary controller 136 includes the bypass control module 306 responding to a temperature feedback parameter, where the temperature feedback parameter includes the intake manifold temperature 312 and/or the exhaust stream temperature 342. The bypass control module 306 utilizes the temperature feedback parameter to target a temperature of the intake manifold and/or exhaust stream, and to modulate the available commands 316, 318, 344 according to the present conditions 310, 340 to achieve the target temperature.

The procedural description which follows provides an illustrative embodiment of performing procedures for elevating exhaust temperatures with a charge air cooler. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

An exemplary procedure includes an operation to determine that an exhaust stream temperature elevation request is present, to determine present engine operation conditions, and, in response to the exhaust stream temperature elevation request and the present engine operating conditions, to operate an EGR bypass valve and/or a charge air cooler bypass valve to increase an intake manifold temperature above a nominal intake manifold temperature. In certain embodiments, the operation to determine that the exhaust stream temperature elevation request is present includes determining a low engine load condition, a cold ambient air condition, a cold engine operating temperature condition, an aftertreatment temperature request condition, and/or an aftertreatment regeneration request condition.

In certain embodiments, the procedure includes an operation to control the EGR bypass valve as a binary valve having an ON and an OFF position. Certain exemplary operations of the procedure include preferentially utilizing the EGR bypass valve to increase the intake manifold temperature, and switching to utilizing the charge air cooler bypass valve in response to an intake manifold temperature limit, an engine operating condition, an engine startup condition, an engine load value being lower than a threshold, and/or an EGR flow control valve temperature limit. Other exemplary operations include preferentially utilizing, in order, the EGR bypass valve, the charge air cooler bypass valve, and a fuel-consuming temperature generation system to increase the intake manifold temperature.

Another exemplary procedure includes an operation to utilize the EGR bypass valve to increase the intake manifold temperature at a first predefined set of engine operating conditions, and an operation to utilize the charge air cooler bypass valve to increase the intake manifold temperature at a second predefined set of engine operating conditions. Certain embodiments include an operating the EGR bypass valve as a binary valve having an ON and an OFF position, and operating the charge air cooler bypass valve as a modulated valve. Another exemplary procedure includes operating the EGR cooler and/or the charge cooler as a heater to increase the intake manifold temperature.

As is evident from the figures and text presented above, a variety of embodiments according to the present invention are contemplated.

One exemplary embodiment is a system including an internal combustion engine receiving an intake stream from an intake manifold and delivering an exhaust stream to an exhaust manifold, and an EGR flow path fluidly coupling the exhaust manifold to the intake manifold, where the EGR flow path includes an EGR cooler path and an EGR cooler bypass path. The system further includes a turbocharger that compresses intake air on a compression side and receives work from the exhaust stream on a turbine side, a compressed intake flow path fluidly coupling the compression side of the turbocharger to the intake manifold, and an EGR bypass valve that selectively divides the EGR flow between the EGR cooler path and the EGR cooler bypass path. The system further includes a charge air bypass valve that reduces an amount of cooling of compressed intake air out of the compression side of the turbocharger, and an aftertreatment component receiving the exhaust stream from the turbine side of the turbocharger. The aftertreatment component requires at least intermittent exhaust stream temperature elevation. The exemplary system further includes a controller that determines that an exhaust stream temperature elevation request is present, and provides a charge air cooler bypass valve command and an EGR bypass valve command in response to the exhaust stream temperature elevation request.

In certain embodiments, the controller further performs at least some of the following exemplary operations. An exemplary operation includes providing the EGR bypass valve command as a binary command having possible values of ON and OFF, or zero bypass and full bypass. Another exemplary operation includes preferentially utilizing the EGR bypass valve command to achieve the exhaust stream temperature elevation request, and switching to utilizing the charge air cooler bypass valve command in response to an intake manifold temperature limit, an engine operating condition, an engine startup condition, an engine load value being lower than a threshold, and/or an EGR flow control valve temperature limit. Another exemplary operation includes preferentially utilizing, in order, the EGR bypass valve command, the charge air cooler bypass valve command, and a fuel-consuming temperature generation system to achieve the exhaust stream temperature elevation request. Another exemplary operation includes utilizing the EGR bypass valve command to achieve the exhaust stream temperature elevation request at a first predefined set of engine operating conditions, and utilizing the charge air cooler bypass valve command to achieve the exhaust stream temperature elevation request at a second predefined set of engine operating conditions. A further exemplary operation includes the EGR bypass valve command being a binary command having possible values of ON and OFF, and the charge air cooler bypass valve command being a modulated command. Yet another exemplary operation includes operating the EGR cooler and/or the charge cooler as a heater in response to the exhaust stream temperature elevation request.

Certain exemplary systems further include a second turbocharger stage, where the charge air cooler cools compressed air from either turbocharger stage, or two charge air coolers cool compressed air from each turbocharger stage. The charge air coolers may be water (engine coolant) jacket coolers, air-to-air coolers, and/or any other type of cooler known in the art. Where two charge air coolers are present, the system includes the controller performing any described operations, including providing a first charge air cooler bypass valve command and/or a second charge air cooler bypass valve command, with regard to either or both of the coolers, either in parallel, in series, or selectively according to present operating conditions of the system. In certain embodiments, the system includes a plurality of EGR bypass valves configured in a multiple (e.g. parallel) and/or staged (e.g. series) flow arrangement. In certain embodiments, the charge air cooler bypass valve(s) reduce the amount of cooling of the compressed air by selectively dividing the compressed intake air between the charge air cooler path and the charge air cooler bypass, and/or by selectively modulating a coolant flow rate in a cooling jacket of the charge air cooler.

Another exemplary embodiment is a method including determining that an exhaust stream temperature elevation request is present, determining present engine operation conditions, and, in response to the exhaust stream temperature elevation request and the present engine operating conditions, operating an EGR bypass valve and/or a charge air cooler bypass valve to increase an intake manifold temperature above a nominal intake manifold temperature. In certain embodiments, the determining that the exhaust stream temperature elevation request is present includes determining a low engine load condition, a cold ambient air condition, a cold engine operating temperature condition, an aftertreatment temperature request condition, and/or an aftertreatment regeneration request condition.

In certain embodiments, the method includes controlling the EGR bypass valve as a binary valve having an ON and an OFF position. Certain exemplary methods include preferentially utilizing the EGR bypass valve to increase the intake manifold temperature, and switching to utilizing the charge air cooler bypass valve in response to an intake manifold temperature limit, an engine operating condition, an engine startup condition, an engine load value being lower than a threshold, and/or an EGR flow control valve temperature limit. Other exemplary methods include preferentially utilizing, in order, the EGR bypass valve, the charge air cooler bypass valve, and a fuel-consuming temperature generation system to increase the intake manifold temperature. Another exemplary method includes utilizing the EGR bypass valve to increase the intake manifold temperature at a first predefined set of engine operating conditions, and utilizing the charge air cooler bypass valve to increase the intake manifold temperature at a second predefined set of engine operating conditions. The EGR bypass valve may be operated as a binary valve having an ON and an OFF position, and the charge air cooler bypass valve may be operated as a modulated valve. Another exemplary method includes operating the EGR cooler and/or the charge cooler as a heater to increase the intake manifold temperature.

Yet another exemplary embodiment is an apparatus including an exhaust stream temperature module that determines that an exhaust stream temperature elevation request is present, an engine conditions module that determines present engine operating conditions, and a bypass control module that increases an intake manifold temperature above a nominal intake manifold temperature by operating at least one of an EGR bypass valve and a charge air cooler bypass valve in response to the exhaust stream temperature elevation request and the present engine operating conditions. The exemplary apparatus includes the exhaust stream temperature module determining that the exhaust stream temperature elevation condition request is present in response to a low engine load condition, a cold ambient air condition, a cold engine operating temperature condition, an aftertreatment temperature request condition, and/or an aftertreatment regeneration request condition.

In certain embodiments, the bypass control module operates the EGR bypass valve as a binary valve having an ON and an OFF position. An exemplary apparatus includes the bypass control module preferentially utilizing the EGR bypass valve to increase the intake manifold temperature, and switching to utilizing the charge air cooler bypass valve in response: an intake manifold temperature limit, an engine operating condition, an engine startup condition, an engine load value being lower than a threshold, and/or an EGR flow control valve temperature limit. An exemplary apparatus includes the bypass control module preferentially utilizing, in order, the EGR bypass valve, the charge air cooler bypass valve, and a fuel-consuming temperature generation system to increase the intake manifold temperature.

An exemplary apparatus includes the bypass control module further utilizing the EGR bypass valve to increase the intake manifold temperature at a first predefined set of engine operating conditions, and utilizing the charge air cooler bypass valve to increase the intake manifold temperature at a second predefined set of engine operating conditions. A further exemplary apparatus includes the bypass control module operating the EGR bypass valve as a binary valve having an ON and an OFF position, and operates the charge air cooler bypass valve as a modulated valve.

In certain embodiments, the apparatus includes a cooler heating capability module that determines whether present system operating conditions indicate an EGR cooler heating capability and/or a charge cooler heating capability, and the bypass control module further operates the EGR cooler and/or the charge cooler as a heater to increase the intake manifold temperature in response to the EGR cooler heating capability and/or the charge cooler heating capability. An exemplary apparatus includes the bypass control module responding to a temperature feedback parameter, where the temperature feedback parameter includes the intake manifold temperature and/or the exhaust stream temperature.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine receiving an intake stream from an intake manifold and delivering an exhaust stream having a temperature to an exhaust manifold;

an EGR flow path fluidly coupling the exhaust manifold to the intake manifold, the EGR flow path including an EGR cooler path and an EGR cooler bypass path;

a turbocharger compressing intake air on a compression side and receiving work from the exhaust stream on a turbine side;

a compressed intake flow path fluidly coupling the compression side of the turbocharger to the intake manifold;

an EGR bypass valve structured to selectively divide the EGR flow between the EGR cooler path and the EGR cooler bypass path;

a charge air cooler bypass valve structured to reduce an amount of cooling of compressed intake air out of the compression side of the turbocharger;

an aftertreatment component receiving the exhaust stream from the turbine side of the turbocharger, the aftertreatment component requiring at least intermittent exhaust stream temperature elevation;

a fuel-consuming temperature generation system, and a controller configured to increase the temperature of the exhaust stream from the internal combustion engine for thermal management of the aftertreatment component by controlling a charge air cooler bypass valve and an EGR bypass valve, wherein the controller is further configured to achieve the increase in the temperature of the exhaust stream by first utilizing the EGR bypass valve to direct all EGR flow through the EGR cooler bypass path and, in response to an intake manifold temperature limit of the intake manifold, switching to utilize the charge air cooler bypass valve to reduce cooling of compressed intake air to achieve the increase in the temperature of the exhaust stream while the EGR bypass valve is closed to direct all the EGR flow through the EGR cooler path and, in response to a required increase in the temperature of the exhaust stream not being met while the EGR bypass valve is closed and the compressed intake air bypasses the charge air cooler, operating the fuel-consuming temperature generation system to achieve the increase in the temperature of the exhaust stream.

2. The system of claim 1, wherein the EGR bypass valve command is a binary command having possible values of ON and OFF and wherein the charge air cooler bypass valve command is a modulated command.

3. The system of claim 1, wherein the controller is further configured to operate at least one of an EGR cooler in the EGR cooler path and a charge air cooler in the intake as a heater to increase the temperature of the exhaust stream.

4. The system of claim 1, further comprising a second turbocharger stage, wherein a charge air cooler in the intake cools compressed air from either turbocharger stage.

5. The system of claim 4, further comprising a second charge air cooler that cools the compressed air from the other turbocharger stage.

6. The system of claim 5, wherein the controller is further configured to provide a second charge air bypass valve command.

7. The system of claim 1, wherein the charge air cooler bypass valve reduces the amount of cooling by selectively modulating a coolant flow rate in a cooling jacket.

8. A method, comprising:

determining that an exhaust stream temperature elevation for an exhaust stream produced by an engine for operation of an aftertreatment component in the exhaust stream is required;

determining present engine operating conditions of the engine; and in response to the required exhaust stream temperature elevation and the present engine operating conditions, operating an EGR bypass valve, a charge air cooler bypass valve, and a fuel-consuming temperature generation system to increase an intake manifold temperature above a nominal intake manifold temperature, wherein the operating includes first utilizing the EGR bypass valve to direct EGR flow through an EGR cooler bypass path to increase the intake manifold temperature to cause an exhaust stream temperature elevation and, in response to an intake manifold temperature limit of an intake manifold of the engine, switching to utilizing the charge air cooler bypass valve to reduce cooling of compressed intake air to cause the exhaust stream temperature elevation while the EGR bypass valve is closed to direct all the EGR flow through an EGR cooler path and then, in response to the required exhaust stream temperature elevation not being met by the compressed intake air bypassing the charge air cooler while the EGR bypass valve is closed, operating the fuel-consuming temperature generation system to achieve the required exhaust stream temperature elevation.

9. The method of claim 8, further comprising determining that the exhaust stream temperature elevation is required in response to at least one parameter selected from the parameters consisting of: a low engine load condition; a cold ambient air condition; a cold engine operating temperature condition; an aftertreatment temperature request condition; and an aftertreatment regeneration request condition.

10. The method of claim 8, further comprising operating the EGR bypass valve as a binary valve having an ON and an OFF position and operating the charge air cooler bypass valve as a modulated valve.

11. The method of claim 8, further comprising operating at least one of the EGR cooler and the charge cooler as a heater to increase the intake manifold temperature.

12. An apparatus, comprising:

an exhaust stream temperature module configured to determine that an exhaust stream temperature elevation of an exhaust stream produced by an engine is required for operation of an aftertreatment component is present;

an engine conditions module configured to determine present engine operating conditions of the engine; and a bypass control module configured to, in response to the required exhaust stream temperature elevation, increase an intake manifold temperature above a nominal intake manifold temperature by first operating an EGR bypass valve to direct all EGR flow through an EGR cooler bypass path to increase the intake manifold temperature to cause an exhaust stream temperature elevation and, in response to an intake manifold temperature limit of the engine, switching to operate a charge air cooler bypass valve to reduce cooling of compressed intake air to cause the exhaust stream temperature elevation while the EGR bypass valve is closed to direct all the EGR flow through an EGR cooler path and, in response to the required exhaust stream temperature elevation not being met while the EGR bypass valve is closed and the charge air cooler is bypassed by the compressed intake air, operating a fuel-consuming temperature generation system to achieve the required exhaust stream temperature elevation.

13. The apparatus of claim 12, wherein the exhaust stream temperature module is further configured to determine that the exhaust stream temperature elevation is required in response to at least one parameter selected from the parameters consisting of: a low engine load condition; a cold ambient air condition; a cold engine operating temperature condition; an aftertreatment temperature request condition; and an aftertreatment regeneration request condition.

14. The apparatus of claim 12, wherein the bypass control module is further configured to operate the EGR bypass valve as a binary valve having an ON and an OFF position and to operate the charge air cooler bypass valve as a modulated valve.

15. The apparatus of claim 12, further comprising a cooler heating capability module configured to determine whether present system operating conditions indicate one of an EGR cooler heating capability and a charge cooler heating capability, wherein the bypass control module is further configured to operate at least one of the EGR cooler and the charge cooler as a heater to increase the intake manifold temperature in response to the one of the EGR cooler heating capability and the charge cooler heating capability.

16. The apparatus of claim 12, wherein the bypass control module is further configured to respond to a temperature feedback parameter, the temperature feedback parameter comprising one of the intake manifold temperature and the exhaust stream temperature.

17. A system, comprising:

an internal combustion engine receiving an intake stream from an intake manifold and delivering an exhaust stream having a temperature to an exhaust manifold;

an EGR flow path fluidly coupling the exhaust manifold to the intake manifold, the EGR flow path including an EGR cooler path and an EGR cooler bypass path;

a turbocharger compressing intake air on a compression side and receiving work from the exhaust stream on a turbine side;

a compressed intake flow path fluidly coupling the compression side of the turbocharger to the intake manifold;

an EGR bypass valve structured to selectively divide the EGR flow between the EGR cooler path and the EGR cooler bypass path;

a charge air cooler bypass valve structured to reduce an amount of cooling of compressed intake air out of the compression side of the turbocharger;

an aftertreatment component receiving the exhaust stream from the turbine side of the turbocharger, the aftertreatment component requiring at least intermittent exhaust stream temperature elevation;

a fuel consuming means for increasing the exhaust temperature, and a means for selectively operating the EGR bypass valve, the charge air cooler bypass valve, and the fuel consuming means in response to an exhaust stream temperature elevation requirement to increase the temperature of the exhaust stream from the internal combustion engine for operation of the aftertreatment component, wherein the means for selectively operating achieves the exhaust stream temperature elevation requirement by first utilizing the EGR bypass valve to direct all EGR flow through the EGR cooler bypass path and, in response to an intake manifold temperature limit of the intake manifold, switching to utilize the charge air cooler bypass valve to reduce cooling of compressed intake air to achieve the exhaust stream temperature elevation requirement while the EGR bypass valve is closed to direct all the EGR flow through the EGR cooler path, and in response to the exhaust stream temperature elevation requirement not being met by the compressed intake air bypassing the charge air cooler while the EGR bypass valve is closed, operating the fuel consuming means to meet the exhaust stream temperature elevation requirement.

18. The system of claim 17, further comprising a means for operating the EGR bypass valve in a binary manner and a means for operating the charge air cooler bypass valve in a modulated manner.

19. The system of claim 17, wherein the means for selectively operating further comprises a means for reducing a coolant flow to the charge air cooler.

* * * * *